US006547374B2

(12) United States Patent
Shimosato et al.

(10) Patent No.: US 6,547,374 B2
(45) Date of Patent: Apr. 15, 2003

(54) INK JET PRINTER HEAD AND METHOD FOR MANUFACTURING THE SAME

(75) Inventors: Masashi Shimosato, Tagata-gun (JP); Isao Suzuki, Tagata-gun (JP)

(73) Assignee: Toshiba TEC Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/887,432

(22) Filed: Jun. 25, 2001

(65) Prior Publication Data

US 2001/0055050 A1 Dec. 27, 2001

(30) Foreign Application Priority Data

Jun. 26, 2000 (JP) ..... 2000-191906

(51) Int. Cl.[7] ..... B41J 2/045
(52) U.S. Cl. ..... 347/68
(58) Field of Search ..... 347/54, 68, 69, 347/70, 71; 456/655

(56) References Cited

U.S. PATENT DOCUMENTS 5,030,322 A * 7/1991 Shimada et al. ..... 156/655
6,074,048 A 6/2000 Hotomi et al. ..... 347/71
6,113,225 A * 9/2000 Miyata et al. ..... 347/70

FOREIGN PATENT DOCUMENTS

| | | |
|---|---|---|
| EP | 0 863 008 | 9/1998 |
| JP | 7-26023 | 1/1995 |
| JP | 8-52872 | 2/1996 |
| JP | 8-290569 | 11/1996 |

* cited by examiner

*Primary Examiner*—Anh T. N. Vo
(74) *Attorney, Agent, or Firm*—Oblon, Spivak, McClelland, Maier & Neustadt, P.C.

(57) ABSTRACT

The present invention provides an ink jet printer head having a pressure chamber to jet ink by deformation of a piezoelectric member provided in the pressure chamber. The piezoelectric member has an electrode for applying electricity to the piezoelectric member. The present invention provides an insulation layer on the electrode formed by vapor deposition method, which has high adhesion and throwing power. Thus, a plurality of electrodes can be covered by the insulation layer even though these electrodes are not provided on the same plane. Accordingly, the ink jet printer head can be used for a long time in steady without deterioration of the piezoelectric member and the ink in case of using conductive ink like water ink.

19 Claims, 6 Drawing Sheets

INK JET PRINTER HEAD AND METHOD FOR MANUFACTURING THE SAME

CROSS REFERENCE TO RELATED APPLICATION

The present application is based on Japanese Priority Document 2000-191906 filed on Jun. 26, 2000, the content of which is incorporated herein by reference.

BACKGROUND OF THE INVENTION

1. Field of the Invention

The present invention relates to an ink jet printer head being capable of using conductive ink like water ink and the manufacturing the same.

2. Discussion of the Background

An ink jet printer, comprising a pressure chamber, at least part of which is formed out of piezoelectric member, a nozzle formed in the pressure chamber, and means for applying voltage to the piezoelectric member, so as to jet ink form the pressure chamber through the nozzle using shear mode strain of the pressure chamber generated by applying voltage to the piezoelectric member, has been used so far.

Japanese laid-open publication (unexamined publication) document Hei 8-52872 discloses an ink jet printer head having a pressure chamber covered with an insulation layer consisting of parylene (registered trade mark) or the like by using CVD (Chemical Vapor Deposition), for preventing deterioration of the ink. The document Hei 8-52872 discloses the technique to protect an electrode provided in the pressure chamber by the insulation layer so as to prevent flowing up electricity in the ink in case of using conductive ink so that the ink may be protected from deterioration caused by flowing up electricity therein. The document Hei 8-52872 also discloses the technique to be capable of uniformly forming the insulation layer consisting of parylene or the like on a substrate having complicated and fine shape like inner surface of the pressure chamber of the ink jet printer head or the like by CDV method.

Japanese laid-open publication (unexamined publication) document Hei 8-290569 discloses an ink jet printer head, which applies voltage to an electrode on a piezoelectric member, portion inserted into a pressure chamber of which is coated by polyimide resin by using spin coating method for obtaining stability and durability of the piezoelectric member, to generate displacement of the piezoelectric member toward a nozzle so as to jet the ink contained in the pressure chamber. Thus, the document Hei 8-290569 discloses the technique for preventing the ink to penetrate into the piezoelectric member so as to improve stability and durability of the piezoelectric member.

The drawbacks of the above techniques disclosed in the documents Hei 8-52872 and 8-290569 are now explained.

Because the parylene vapor deposition layer formed by CVD method has small adhesion to the substrate, it is required to execute under finishing like silane coupling finishing when the insulation layer is formed. Thus, the technique disclosed in the document Hei 8-52872 has drawback that the step of forming insulation layer is increased, so that the operability or workability for forming insulation layer is complicated and troublesome.

The technique disclosed in the document Hei 8-290569 improves stability and durability of the piezoelectric member. However, the technique has drawback that the electricity flows up into the ink contained in the pressure chamber via an ink channel in case of using conductive ink because the electrode is attached to the polyimide resin coated on the piezoelectric member.

SUMMARY OF THE INVENTION

Accordingly, an object of the present invention is to obtain an ink jet printer head and method for manufacturing the same being capable of using the ink jet printer head for a long time in steady without deterioration of the piezoelectric member and the ink in case of using conductive ink like water ink.

Another object of the present invention is to obtain an ink jet printer head and method for manufacturing the same being capable of using the ink jet printer head for a long time in steady without deterioration of the piezoelectric member and the ink in case of using conductive ink like water ink, even though the piezoelectric member deteriorates polarization property under high temperature.

These and further object of the present invention are achieved by the novel ink jet printer head and method for manufacturing the same of the present invention.

According to the novel ink jet printer head of the present invention, comprising a pressure chamber, at least part of which is formed out of piezoelectric member, to be supplied ink, a nozzle connecting the pressure chamber to outside, an electrode for applying voltage to the piezoelectric member; and an insulation layer, covering the electrode, comprising from organic macromolecule material to be capable of forming by vapor deposition polymerization method. Accordingly, the electrode provided on the piezoelectric member is covered with insulation layer comprising from organic macromolecule material, which is capable of forming by vapor deposition polymerization method, having high adhesion and throwing power, so that the electrodes not disposed on the same plane respectively may be covered with insulation layer.

According to the novel method for an ink jet printer head of the present invention, comprising the steps of forming a pressure chamber, at least part of which is formed out of piezoelectric member, forming an electrode for applying voltage to the piezoelectric member; and covering the electrode with an insulation layer comprising from organic macromolecule material by vapor deposition polymerization method. Accordingly, the electrode provided on the piezoelectric member is covered with insulation layer comprising from organic macromolecule material, which is capable of forming by vapor deposition polymerization method, having high adhesion and throwing power, so that the electrodes not disposed on the same plane respectively may be covered with insulation layer.

BRIEF DESCRIPTION OF THE DRAWINGS

A more complete appreciation of the present invention and many of the attendant advantages thereof will be readily obtained as the same becomes better understood by reference to the following detailed description when considered in connection with the accompanying drawings, wherein.

DETAILED DESCRIPTION OF THE PREFERRED EMBODIMENTS

A first embodiment of the present invention is now explained with reference to FIGS. 1–3. The first embodiment is directed to an ink jet printer.

Figure 1:
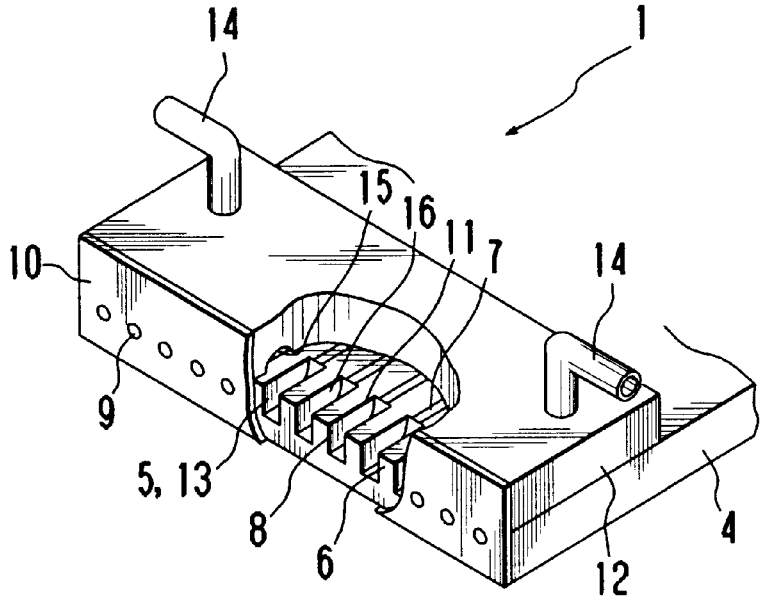
FIG. 1 is a perspective view of an ink jet printer head according to a first embodiment of the present invention.
Figure 2:
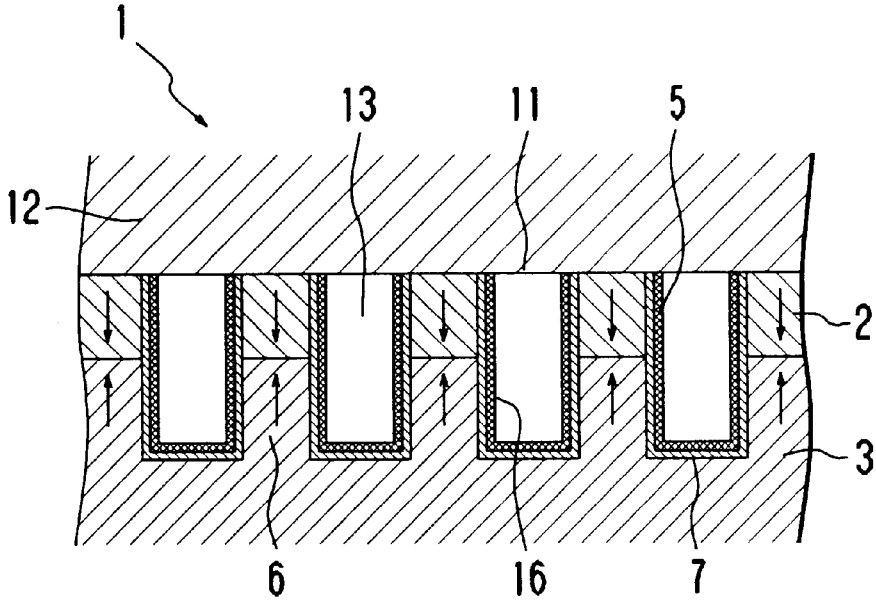
FIG. 2 is a partial longitudinal sectional view of the ink jet printer head broken away in right-angled direction to longer direction of grooves.

FIG. 1 is a perspective view of an ink jet printer head according to a first embodiment of the present invention. FIG. 2 is a partial longitudinal sectional view of the ink jet printer head broken away in right-angled direction to longer direction of grooves.

An ink jet printer head 1 has multi-layered piezoelectric member 4 formed by layered two piezoelectric members 2 and 3 (refer FIG. 2) comprising from piezoelectric material like PZT (lead zirconate titanate). The polarization direction of the piezoelectric members 2 and 3 are reverse along thickness thereof.

The multi-layered piezoelectric member 4 provides a plurality of grooves 5 opening toward upper and front surface of the multi-layered piezoelectric member 4 in parallel. Grinding technology using dicing with a diamond wheel, which is used for IC wafer cutting, is uses for forming these grooves 5. Each grooves 5 is divided by a plurality of supports 6. The grooves 5 is determined in depth range of 0.2–1.0 mm (up-and-down direction in FIG. 2), width range of 20–200 $\mu$m (right and left direction in FIG. 2), and length range of 1–500 mm(right angled direction to the paper in FIG. 2).

The inner surface of the grooves 5 and the upper surface of the multi-layered piezoelectric member 4 provides a plurality of electrodes 7 forming by the electroless nickel plating method.

It is eliminated to explain with respect to the electroless nickel plating method since the technique is well known, but, the method presents to form the electrodes 7 even in the fine area like the inner surface of the grooves 5.

In the first embodiment of the present invention, nickel is used for the material forming the electrodes 7, but the present invention does not limit the material of the electrodes 7 to nickel. For instance, gold, copper or the like may be used as the material of the electrodes 7.

A plurality of front openings 8 of the grooves 5, which connects the grooves 5 to the front surface of the multi-layered piezoelectric member 4, is plugged up with a nozzle plate 10 having a plurality of nozzles 9. The nozzle plate 10 has a thickness of 10–100 $\mu$m.

A plurality of upper openings 11 of the grooves 5, which connects the grooves 5 to the upper surface of the multi-layered piezoelectric member 4, is plugged up with a lid 12. The lid 12 provides an ink supply channel 15 as an ink channel at backside thereof. The ink supply channel 15 allows an ink tank (not shown) containing the ink to connect via a pair of ink supply pipes 14 for supplying each pressure chamber 13 (described below).

In condition of closing the front opening 8 and the upper opening 11 of the multi-layered piezoelectric member 4 (head substrate) with the nozzle plate 10 and the lid 12, the pressure chambers 13 are produced. Each pressure chamber 13 is connected to each other via the ink channel 15. The ink jet printer head 1 is connected to a controller (not shown) and a power source (not shown) via a flexible cable (not shown). Thus, in printing operation, driving pulse (voltage), printing data or the like is input into the ink jet printer head 1 via the flexible cable.

In operation of the ink jet printer using the ink jet printer head 1, voltage is applied to the pair of electrodes 7 disposed at both inner sides of the pressure chamber 13 contributing ink jetted in condition of supplying ink into the pressure chamber 13. The pair of supports 6 corresponding to the electrodes 7 to which the voltage is applied deforms so as to increase the volume in the pressure chamber 13 by shear mode strain of the piezoelectric members 2 and 3 having reverse polarization directions each other. Then, the pair of supports 6 restores rapidly by applying voltage in reverse polarity to the electrodes 7. Such rapid restoration of the pair of supports 6 causes the ink in the pressure chamber 13 to be pressed so as to jet the ink from the nozzle 9 as ink drop.

When the voltage is applied to the electrodes 7 in condition of filling the pressure chamber 13 of the ink jet printer head 1 with high conductive ink like water ink in, the electricity flows through the ink filled in each pressure chamber 13 via the ink filled up in the ink channel 15. Thus, the electricity flowing through the ink may cause the ink to generate electrolysis so as to generate bubbles in the pressure chamber 13. The electricity flowing through the ink also may cause the electrodes 7 to precipitate the solid-state material by the electrophoresis. Consequently, the electrodes may not operate correctly.

The ink jet printer head 1, in order to avoid above mentioned problem, provides the insulation layer 16 comprised from polyurea by vapor deposition polymerization method on the surface of the electrodes 7 contacting to the ink, that is, the inner surface of the pressure chambers 13. The vapor deposition polymerization method is defined as the method for forming the organic macromolecule material on the substrate by adding the monomer evaporated by thermal energy and activated thereby to the substrate for forming the layer so as to generate polymerization reaction on the substrate. The insulation layer 16 is formed by polyurea in the first embodiment of the present invention, but polyimide, polyimideamide, polyamide, or polyazomethine, for instance, may be used for forming the insulation layer 16.

Next, the step of forming the insulation layer 16 which covers the electrodes 7 will be explained hereinafter. The insulation layer 16 is formed by using a vapor deposition polymerization apparatus 17 shown in FIG. 3 in this embodiment.

Figure 3:
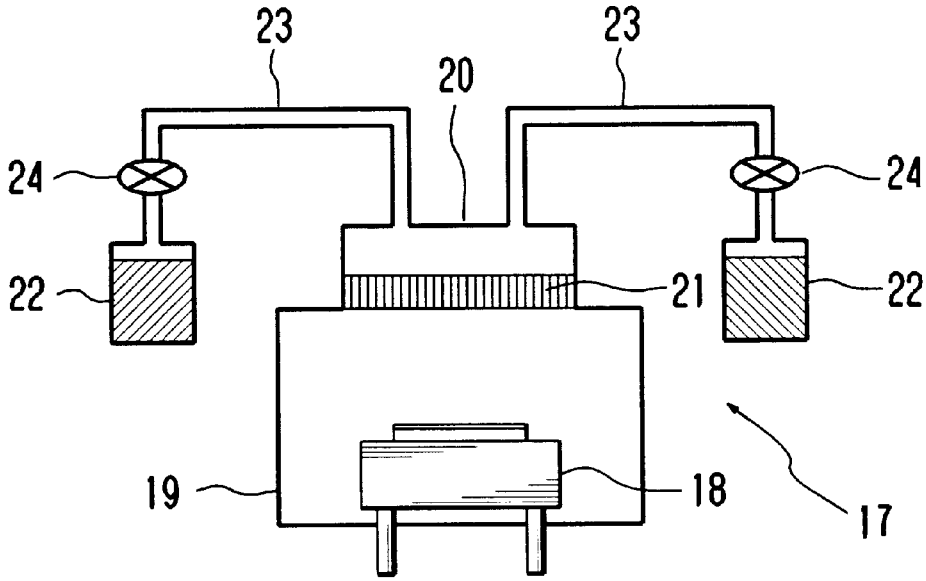
FIG. 3 is a block schematic diagram of a vapor deposition polymerization apparatus.

FIG. 3 is a block schematic diagram of the vapor deposition polymerization apparatus 17. The vapor deposition polymerization apparatus 17 has a chamber 19 containing a stage 18 for holding a sample (the piezoelectric member 2 and 3 on which the grooves 5 and the electrodes 7 are formed in this embodiment) that is intended to form a layer by using vapor deposition polymerization. The stage 18 provides a temperature control mechanism (not shown). The temperature of the sample can be kept in ordinary temperature (outside temperature) by the temperature control mechanism since the insulation layer 16 is comprised from polyerea.

The chamber 19 contains inside temperature control mechanism (not shown) for controlling the inside temperature of the chamber 19. The inside temperature of the chamber 19 is kept in temperature range of ordinary temperature to 50° C. since the insulation layer 16 is comprised from polyerea.

The chamber 19 also provides a pressure reducing mechanism (not shown) for reducing the pressure in the chamber 19. The pressure reducing mechanism may be structured as the mechanism that compels the air in the chamber 19 to exhaust to outside of the chamber 19 with a fan or the like.

A mixing tank 19 is provided on the chamber 19. The mixing tank 19 connects with the chamber 19 via a shower plate 21 having a plurality of holes.

The vapor deposition polymerizing apparatus 17 provides a plurality of evaporation tanks 22 containing source monomer material for adding to the sample. Each evaporation tanks 22 contains 4,4'diaminophenylmethane (MDA) and 4,4'diphenylmethaneisocyanato as the source monomer material used for forming the insulation layer 16 comprised from polyurea.

Each evaporation tanks 22 contains heating mechanism (not shown) for heating the source monomer material. Each evaporation tanks 22 connects with the mixing tank 20 via a plurality of monomer introduction pipes 23 respectively. Each monomer introduction pipes 23 provides a plurality of valves 24 being capable of opening and closing the monomer introduction pipes 23. The monomer introduction pipes 23 are kept in close by the valves 24 except when vapor deposition polymerization is executed.

Next, step for forming the insulation layer 16 will be explained. First of all, multi-layered piezoelectric member 4, the grooves 5 of which is formed the electrodes 7 is attached to the stage 18 so as to direct the upper surface on which the grooves 5 are formed toward upper direction. Portions not forming the insulation layer 16 like electrodes 7 to which the flexible cable will connect or the like should be masked previously.

As next stage, the evaporation tanks 22 are heated by using a heating mechanism. The heated source monomer material evaporates as vapor. The monomer introduction pipes 23 are opened after the source monomer was vaporized sufficiently. Thus, vaporized source monomer material is introduced into the mixing tank 20 via the monomer introduction pipes 23. Several kind of monomers are mixed in the mixing tank 20 so as to generate mixed monomer in the mixing tank 20.

The pressure of the inside of the chamber 19 is reduced by using a pressure reducing mechanism. Thus, the inside pressure of the mixing tank 20 becomes different to the inside pressure of the chamber 19, so that the mixed monomer is introduced into the chamber via the shower plate 21.

The mixing monomer introduced into the chamber 19 adds to the multi-layered piezoelectric member 4. The source monomer material added on the surface of the multi-layered piezoelectric member 4 begins to deposit to the surface of the multi-layered piezoelectric member 4 on condition that the temperature of the multi-layered piezoelectric member 4 and the inside of the chamber 19 are controlled. Then, the insulation layer 16 comprised from polyerea is formed on the surface of the multi-layered piezoelectric member 4.

In operation of the vapor deposition polymerization method, the materials desired to form as the layer is added to the substrate in unit of monomer so as to deposit on the substrate, so that the monomer molecule penetrates to the substrate satisfactorily even though the substrate has complicated form, and the insulation layer 16 can be formed uniformly to even fine portion regardless of shape of the substrate thereby.

Also, since the insulation layer 16 is formed by using the vapor deposition polymerization method having high adhesion and throwing power, under finishing to the surface of the multi-layered piezoelectric member 4 can be eliminated.

Further more, forming layer method, other than the vapor deposition polymerization, requiring under finishing to the substrate has difficulties to process the under finishing to the substrate having complicated form like the ink jet printer head 1. Thus, the present invention using the vapor deposition polymerization has advantage to be able to form the insulation layer 16 uniformly to even fine portion, and the operability and workability for forming the insulation layer 16 can be improved thereby.

The present invention presents the method for covering the electrodes 7 with insulation layer 16 comprised from polyurea, which is one of organic macromolecule material, by using the vapor deposition polymerization method having high adhesion and throwing power, so that the electrodes 7 not arranged on the same plane can be covered satisfactorily at the same time. Thus, the ink jet printer head 1 of the present invention is capable of using for a long time in steady without deterioration of the ink in case of using conductive ink like water ink.

In the ink jet printer head 1 of the present embodiment, the polarization direction of the piezoelectric members 2 and 3 is set at right angle to the direction of the electric field generated by applying voltage to the piezoelectric members 2 and 3. In the ink jet printer head 1 using shear mode strain of the piezoelectric members 2 and 3, it is difficult to polarize the piezoelectric members 2 and 3 again after deterioration of the polarization with respect to the piezoelectric members 2 and 3.

The polarization property deteriorates by the over heat of the piezoelectric members 2 and 4, for instance. On the contrast, present embodiment introduces polyurea for the material of the insulation layer 16 being capable of beginning deposition in low temperature, so that the insulation layer 16 can be formed on the electrodes 7 in sufficient low temperature to the extent of not deteriorating the polarization property of the piezoelectric members 2 and 3. Accordingly, the ink jet printer head 1 using shear mode strain of the present invention is capable of using for a long time in steady without deterioration of the piezoelectric member.

The first embodiment of the present invention introduces the step for forming the insulation layer 16 before attaching the nozzle plate 10 and lid 12 to the multi-layered piezoelectric member 4. But, this step is not limited for manufacturing the ink jet printer head 1 of the present invention. As other embodiment, the insulation layer 16 may be formed after attaching the nozzle plate 10 and lid 12 to the multi-layered piezoelectric member 4, under appreciation of high throwing power of the vapor deposition polymerization.

This modified step can eliminate the masking operation to the portions not forming the insulation layer 16 like the portions forming electrode 7 or the like.

The first embodiment of the present invention also introduces the step for forming the insulation layer 16 out of polyurea in order to prevent the deterioration with respect to the polarization property of the electrodes 2 and 3 caused by over heat. However, polyimide can be used for the material of the insulation layer 16 on condition that a method not causing the deterioration to the polarization property of the electrodes 2 and 3, for instance:

a method for forming the pressure chamber 13 by using piezoelectric material not causing the deterioration of the polarization under temperature of deposition reaction in imidate;

a method for forming the insulation layer 16 using imidate by not temperature condition but chemical; or the like is used. Further more, the insulation layer 16 can be formed from polyimide on condition that PZT having heat resistance not causing the deterioration in the forming temperature of the layer is used.

A second embodiment of the present invention is now explained with reference to FIG. 4. The same parts as those in the first embodiment are designated by the same reference numerals, and are not again explained herein. In the second embodiment of the present invention, the polarization direction of the piezoelectric member is different to the same of the firs embodiment of the present invention. The piezoelectric member is polarized in right and left direction in FIG. 4.

Figure 4:
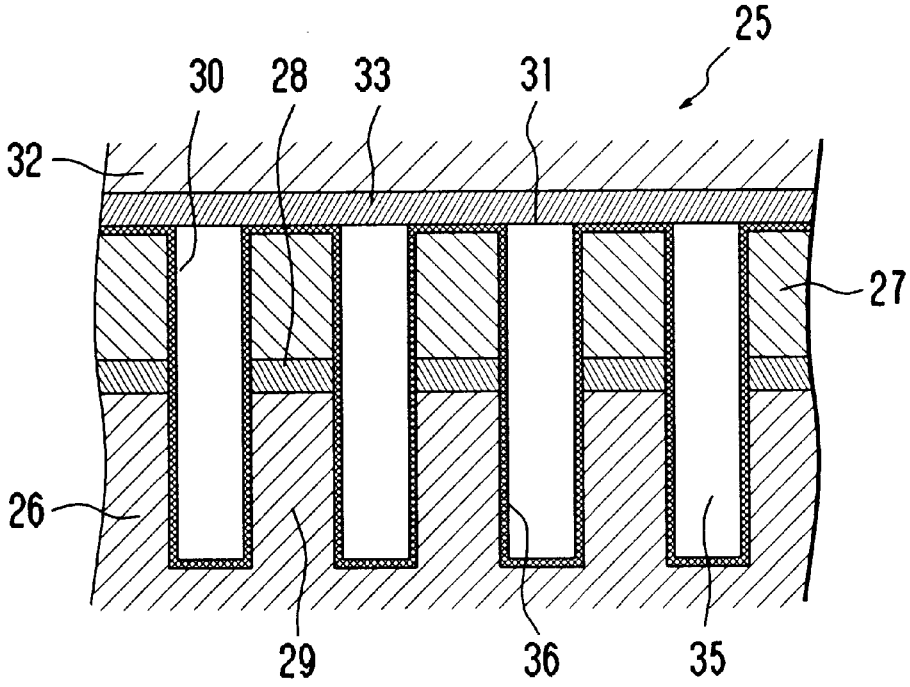
FIG. 4 is a partial longitudinal sectional view of an ink jet printer head broken away in right-angled direction to longer direction of grooves according to a second embodiment of the present invention.

FIG. 4 is a partial longitudinal sectional view of an ink jet printer head broken away in right-angled direction to longer direction of grooves according to a second embodiment of the present invention. The ink jet printer head 25 provides a piezoelectric member 27 layered on a substrate 26. A plurality of electrodes 28 is provided between the substrate 26 and the piezoelectric member 27. The substrate 26 and the piezoelectric member 27 are adhered via the electrodes 28 by conductive adhesive (not shown).

The ink jet printer 25 provides a plurality of grooves 30 divided in parallel with certain interval by a plurality of supports 29 formed with the substrate 26 and the piezoelectric member 27. The upper and front of the grooves 30 is opened.

There is provided a lid 32 closing upper openings 31 of the grooves 30. The lid 32 provides a common electrode 33 at a surface facing to the ink jet printer head 25. The lid 32 connects to the upper surface of the supports 29 via the common electrodes 33 by conductive adhesive (not shown). The lid 32 also provides an ink channel (not shown) for supplying ink to each pressure chambers 35.

As same to the first embodiment of the present invention, the front openings of the grooves 30 are closed by a nozzle plate 10 having a plurality of ink nozzles 9.

Then, the pressure chambers 35 are formed at the grooves 30 in condition of closing the upper openings 31 and the front openings of the grooves 30 with the lid 32 and the nozzle plate 10.

In operation of an ink jet printer using the ink jet printer head 25, voltage is applied to the pair of electrodes 28 disposed at both inner sides of the pressure chambers 35 contributing ink jetted in condition of supplying ink into the pressure chambers 35. The pair of piezoelectric members 27 corresponding to the electrodes 28 to which the voltage is applied deforms so as to increase the volume in the pressure chambers 35 and restores consequently so as to decrease the volume in the pressure chambers 44. Such restoration of the pair of piezoelectric members 27 causes the ink in the pressure chambers 35 to be pressed so as to jet the ink from the nozzles 9 as ink drops.

When the voltage is applied to the electrodes 28 in condition of filling the pressure chambers 35 of the ink jet printer head 25 with conductive ink, the electricity flows through the ink filled in each pressure chambers 35 via the ink filled up in the ink channel. The electricity flowing through the ink may cause deterioration of the ink, deterioration of the polarization property with respect to the piezoelectric member 27, or the like. Thus, in the second embodiment of the present invention, an insulation layer 36 is formed on the surface of the electrodes 28 which contacts to the ink by using vapor deposition polymerization method before closing the upper openings 31 of the grooves 30 with the lid 32.

The insulation layer 36 is formed on whole inner surface of the pressure chambers 35 because it can improve operability and workability for forming the insulation layer 36 as compared with a process to mask the portions other than the electrodes 28 in the pressure chamber 35.

Accordingly, in case of using conductive ink, the insulation layer 36 covering the electrodes 28 (the inner surface of the pressure chambers 35) prevents electricity to flow through the ink, so that the ink jet printer head 25 of the present invention is capable of using for a long time in steady without deterioration of the ink, producing bubbles in the ink or the like.

Figure 5:
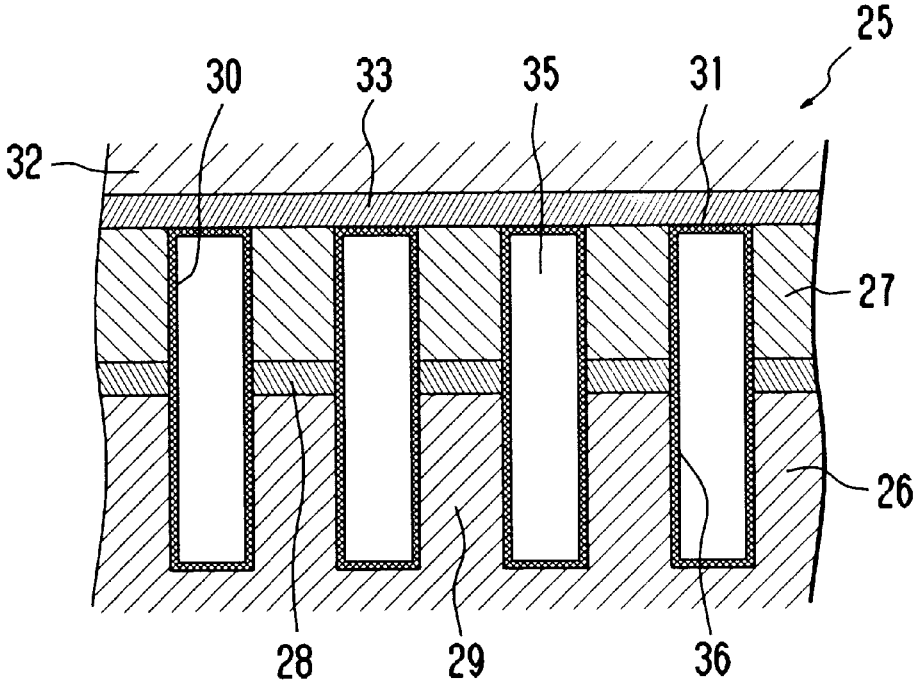
FIG. 5 is a partial longitudinal sectional view of the ink jet printer head broken away in right-angled direction to longer direction of grooves according to the second embodiment with modification of the present invention.

It is not necessary to cover the common electrode 33 because common voltage is applied to the common electrode 33 in each pressure chambers 35. However, as modified embodiment of the second embodiment of the present invention, as shown in FIG. 5, the vapor deposition polymerization method may be executed in condition of closing the upper openings 31 with lid 32 so as to cover the electrodes 28 and common electrode 33 surely with the insulation layer 36. The insulating layer 36 covering not only the electrodes 28 but also common electrode 33 is able to prevent the electricity to flow through the ink surely.

Further more, the insulation layer 36 may be formed before closing the front opening of the grooves 30 with the nozzle plate 10 or after closing the front opening of the grooves 30 with the nozzle plate 10.

A third embodiment of the present invention is now explained with reference to FIG. 6. The same parts as those in the first and second embodiments are designated by the same reference numerals, and are not again explained herein. In the third embodiment of the present invention, the polarization direction of the piezoelectric member is determined as one direction. This point is different to the first and second embodiments of the present invention. Such type of ink jet printer head will be called normal mode type hereinafter.

Figure 6:
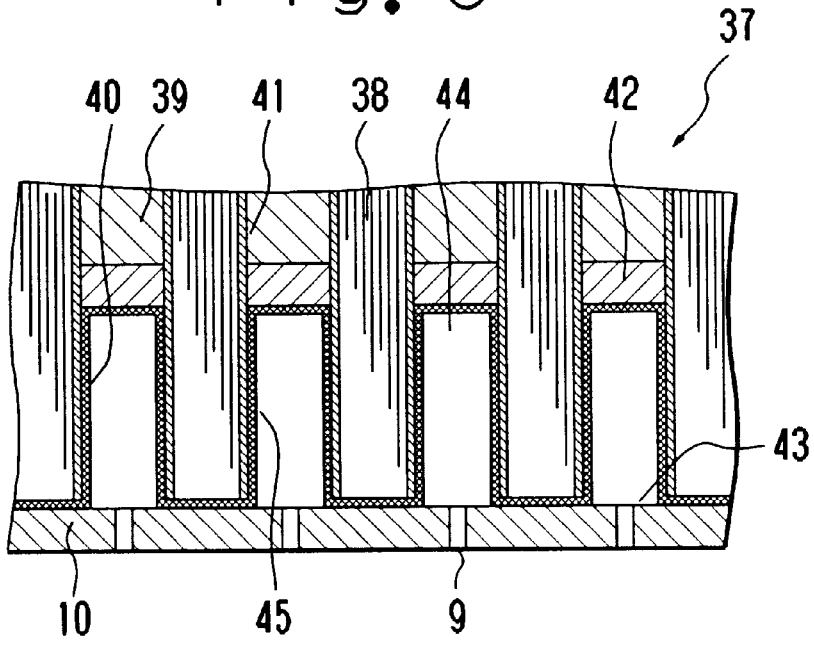
FIG. 6 is a partial horizontal sectional view of the ink jet printer head broken away along longer direction of grooves according to a third embodiment of the present invention.

FIG. 6 is a partial horizontal sectional view of the ink jet printer head broken away along longer direction of grooves according to a third embodiment of the present invention. An ink jet printer head 37 arranges a plurality of multi-layered piezoelectric members 38 on a substrate 39 in certain interval. This arrangement produces a plurality of grooves 40 between the multi-layered piezoelectric members 38. Thus, the multi-layered piezoelectric members 38 operate as a plurality of supports.

Generally, it is difficult to form the grooves 40 to the multi-layered piezoelectric member 38. In the ink jet printer head 37 of the present embodiment, the grooves 40 are formed by the arrangement that the multi-layered piezoelectric members 38 formed as cubic form previously are disposed on the substrate 39. Thus, the grooves 40 are formed easily even though the multi-layered piezoelectric member 38 is used.

Each multi-layered piezoelectric members 38 provides a pair of electrodes 41 at both side thereof (the right and left surfaces of the multi-layered piezoelectric member 38 in FIG. 6). These electrodes 41 are connected with the controller (not shown) and the power source (not shown) for supplying voltage to each multi-layered piezoelectric members 38 via the flexible cable (not shown).

There are provided a plurality of fillers 42 to close the end of the grooves 40 respectively at the end of the grooves.

A front opening 43 of the grooves 40, as same to the first and second embodiment of the present invention, are closed with the nozzle plate 10 having a plurality of nozzles 9.

Upper openings of the grooves 40 are closed with lid (not shown). The lid provides an ink channel (refer in FIG. 1) for supplying ink to each pressure chamber 44 described below.

Then, the pressure chambers 44 are formed at the grooves 40 in condition of closing the grooves 40 with the nozzle plate 10, the fillers 42 and the lid.

In operation of the ink jet printer head 37, voltage is applied to the pair of electrodes 41 disposed at both inner sides of the pressure chambers 44 contributing ink jetted in condition of supplying ink into the pressure chambers 44. The pair of multi-layered piezoelectric members 38 corresponding to the electrodes 41 to which the voltage is applied deforms so as to increase the volume in the pressure chambers 44 and restores consequently so as to decrease the volume in the pressure chambers 44. Such restoration of the pair of multi-layered piezoelectric members 38 causes the ink in the pressure chambers 44 to be pressed so as to jet the ink from the nozzles 9 as ink drops.

When the voltage is applied to the electrodes 41 in condition of filling the pressure chambers 44 of the ink jet printer head 37 with conductive ink, the electricity flows through the ink filled in each pressure chambers 44 via the ink filled up in the ink channel. The electricity flowing through the ink may cause deterioration of the ink or the like. Thus, in the third embodiment of the present invention, insulation layers 45 comprised form polyimide are formed on the surface of the multi-layered piezoelectric members 38 which contact to the ink by using vapor deposition polymerization method before closing the front openings 43 of the grooves 40 with the nozzle plate 10.

The insulation layers 45, comprised form polyimide resin, are formed on the surface of the electrodes 41, which contacts to the ink, in this embodiment. In process of forming the insulation layers 45, the evaporation tank 22 (refer in FIG. 1) contains pyromelliticdianhydride (PDMA) and 4,4'diaminodiphenylether (ODA) as the source polymer material.

Detailed description is eliminated, but as a process for forming the insulation layers 45, the source monomer material is added to the surface of the substrate 39 on which the multi-layered piezoelectric members 38 and the fillers 42 are attached and masked at certain portion, in condition of keeping temperature of 170–230' C. in the chamber. Thus, a macromolecule layer of amino acid is layered on the surface of the grooves 40. The macromolecule layer has hydrophilic amino acid in this state. Thus, the substrate 39 is heated in temperature of over 250° C. so as to cause the amino acid to imidate. Then, the inner surface of the grooves 40 is covered by polyimide resin layer.

In this embodiment, it is introduced to cause the amino acid on the substrate 39 to imidate in temperature 250° C., but the present invention does not limited for causing the amino acid to imidiate. Imidiate can be progressed to the extent of obtaining satisfactory property as the ink jet printer head by increasing process time in temperature 220° C. as compared with temperature 250° C. for instance. Thus, it is possible to use piezoelectric material, the property of which is deteriorated in temperature 250° C. but is not deteriorated in temperature 220° C., for instance, so that wide choice of the piezoelectric material being capable of applying to the ink jet printer head can be obtain.

Accordingly, in case of using conductive ink, the insulation layer 45 covering the electrodes 41 prevents electricity to flow through the ink, so that the ink jet printer head 37 of the present invention is capable of using for a long time in steady without deterioration of the ink, producing bubbles in the ink or the like.

Generally, PZT may cause deterioration of the polarization in high temperature as mentioned above, and the piezoelectric property may be deteriorated thereby. However, in this embodiment, since the normal mode ink jet printer head 37 having same polarization directions with respect to the piezoelectric members is used the polarization can be executed after forming the insulation layers 45 by using electrodes for driving, for instance, even though the multi-layered piezoelectric member 38 was headed in temperature of over 250° C. for imidate.

In this embodiment, since the normal mode ink jet printer head 37 having same polarization direction with respect to the piezoelectric members is used the polarization can be executed again by using electrodes for driving, for instance, even though the polarization property of the multi-layered piezoelectric member 38 is deteriorated while the ink jet printer head 37 is manufactured.

Further more, PZT not polarized previously can be polarized later by using electrodes for driving, for instance, if the polarization directions are same.

Thus, productivity with respect to the normal mode ink jet printer head 37 being capable of polarizing after manufacturing can be improved. Further, since the cost of polyimide is low, using polyimide as the insulation layers 45 can decrease product cost for forming the insulation layers 45.

In this embodiment, the insulation layers 45 comprised from polyimide is applied for the normal mode ink jet printer head 37, but the present invention does not limit such structure. The insulation layer 45 can be formed from polyimide on condition that PZT having heat resistance not causing the deterioration in the forming temperature of the layer is used.

The multi-layered piezoelectric members 38 of this embodiment has cubic shape, the insulation layers 45 can be easily formed to the individual multi-layered piezoelectric members 38 having the electrodes 41 using well known process thereby. However, the process requires arraying the multi-layered piezoelectric members 38 on which the insulation layers 45 have been formed. Thus, the process is complicated.

In this embodiment, the plurality of insulation layers 45 can be formed at the same time by using vapor deposition polymerization method after arraying the multi-layered piezoelectric members 38 on which the insulation layers 45 have been formed, so that the operation for forming the insulation layers 45 on the inside of the grooves 40 can be executed easily.

This embodiment introduces to form the insulation layers 45 before attaching the nozzle plate 10 and the lid to the multi-layered piezoelectric members 38. But, the invention does not limit to form the insulation layers 45 by the process. Since the vapor deposition polymerization method contributes high throwing power, the insulation layers 45 may be formed after attaching the nozzle plate 10 and the lid.

Further, this embodiment introduces to form the insulation layers 45 from polyimide resin, but the present invention does not limit to form the insulation layers 45 from polyimide resin. The insulation layers 45 may be formed from polyurea, for instance.

A fourth embodiment of the present invention is now explained with reference to FIG. 7. The same parts as those in the first, second and third embodiments are designated by the same reference numerals, and are not again explained herein. In this embodiment, polarization direction of the multi-layered piezoelectric member is different to the third embodiment of the present invention.

Figure 7:
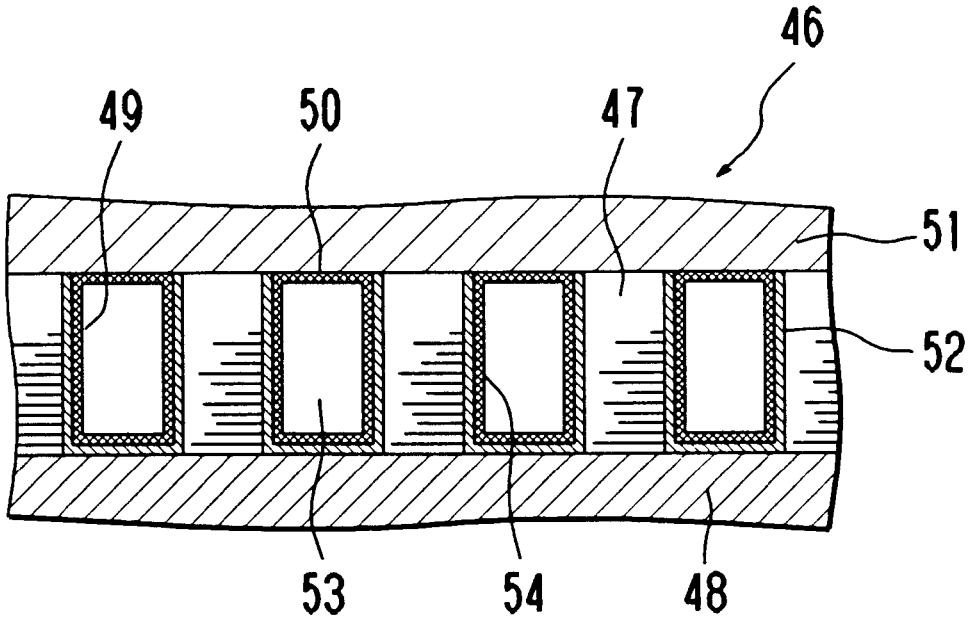
FIG. 7 is a partial longitudinal sectional view of an ink jet printer head broken away in right-angled direction to longer direction of grooves according to a fourth embodiment of the present invention.

FIG. 7 is a partial longitudinal sectional view of an ink jet printer head broken away in right-angled direction to longer direction of grooves according to a fourth embodiment of the present invention. An ink jet printer head 46 arranges a plurality of multi-layered piezoelectric members 47 on a substrate 48 in certain interval. This arrangement produces a plurality of grooves 49 between the multi-layered piezoelectric members 47. Thus, the multi-layered piezoelectric members 47 operate as a plurality of supports.

Generally, it is difficult to form the grooves 49 to the multi-layered piezoelectric member 47. In the ink jet printer head 46 of the present embodiment, the grooves 49 are formed by the arrangement that the multi-layered piezoelectric members 47 formed as cubic form previously are disposed on the substrate 48. Thus, the grooves 49 are formed easily even though the multi-layered piezoelectric member 47 is used.

Upper openings 50 of the grooves 49 are closed with lid 51. The lid 51 provides an ink channel (not shown but refer in FIG. 1). The lid 51 of this embodiment has flexibility which deforms according to the deformation of the multi-layered piezoelectric member 47.

A front opening of the grooves 49, as same to the first and second embodiment of the present invention, are closed with the nozzle plate 10 having a plurality of nozzles 9.

There are provided a plurality of fillers to close the end of the grooves 49 respectively at the end of the grooves.

Then, pressure chambers 53 are formed at inside of the grooves 49 in condition of closing the grooves 49 with the nozzle plate 10, the fillers 42 and the lid.

Inside of each pressure chambers 53 provides an electrode 52. The electrodes 52 are connected with the controller (not shown) and the power source (not shown) for supplying voltage to each multi-layered piezoelectric members 47 via the flexible cable (not shown).

In operation of the ink jet printer head 46, voltage is applied to the pair of electrodes 52 disposed at both inner sides of the pressure chambers 53 contributing ink jetted in condition of supplying ink into the pressure chambers 53. The pair of multi-layered piezoelectric members 47 corresponding to the electrodes 52 to which the voltage is applied deforms so as to increase the volume in the pressure chambers 53 and restores consequently so as to decrease the volume in the pressure chambers 53. Such restoration of the pair of multi-layered piezoelectric members 47 causes the ink in the pressure chambers 53 to be pressed so as to jet the ink from the nozzles 9 as ink drops.

When the voltage is applied to the electrodes 52 in condition of filling the pressure chambers 53 of the ink jet printer head 46 with conductive ink, the electricity flows through the ink filled in each pressure chambers 53 via the ink filled up in the ink channel. The electricity flowing through the ink may cause deterioration of the ink or the like. Thus, in the fourth embodiment of the present invention, insulation layers 54 are formed on the surface of the electrodes 52 which contact to the ink by using vapor deposition polymerization method after closing the upper openings 50 of the grooves 49 with the lid 51.

The insulation layers 54, comprised form polyimide resin, are formed on the surface of the electrodes 52 which contacts to the ink in this embodiment.

Accordingly, in case of using conductive ink, the insulation layer 54 covering the electrodes 52 prevents electricity to flow through the ink, so that the ink jet printer head 46 of the present invention is capable of using for a long time in steady without deterioration of the ink, producing bubbles in the ink or the like.

Generally, PZT may cause deterioration of the polarization in high temperature as mentioned above, and the piezoelectric property may be deteriorated thereby. However, in this embodiment, since the normal mode ink jet printer head 46 having same polarization directions with respect to the piezoelectric members is used the polarization can be executed after forming the insulation layers 54 by using electrodes for driving, for instance, even though the multi-layered piezoelectric member 47 was headed in temperature of over 250° C. for imidate.

In this embodiment, since the normal mode ink jet printer head 46 having same polarization direction with respect to the piezoelectric members is used the polarization can be executed again by using electrodes for driving, for instance, even though the polarization property of the multi-layered piezoelectric member 47 is deteriorated while the ink jet printer head 46 is manufactured.

Further more, PZT not polarized previously can be polarized later by using electrodes for driving, for instance, if the polarization directions are same.

Thus, productivity with respect to the normal mode ink jet printer head 46 being capable of polarizing after manufacturing can be improved. Further, since the cost of polyimide is low, using polyimide as the insulation layers 54 can decrease product cost for forming the insulation layers 54.

The multi-layered piezoelectric members 47 of this embodiment has cubic shape, the insulation layers 54 can be easily formed to the individual multi-layered piezoelectric members 47 having the electrodes 52 using well known process thereby. However, the process requires arraying the multi-layered piezoelectric members 47 on which the insulation layers 54 have been formed. Thus, the process is complicated.

In this embodiment, the plurality of insulation layers 54 can be formed at the same time by using vapor deposition polymerization method after arraying the multi-layered piezoelectric members 47 on which the insulation layers 54 have been formed, so that the operation for forming the insulation layers 54 on the inside of the grooves 49 can be executed easily.

This embodiment introduces to form the insulation layers 54 before attaching the lid 51 to the multi-layered piezoelectric members 47. But, the invention does not limit to form the insulation layers 54 by the process. Since the vapor deposition polymerization method contributes high throwing power, the insulation layers 54 may be formed after attaching the lid 51.

Further, this embodiment introduces to form the insulation layers 54 from polyimide resin, but the present invention does not limit to form the insulation layers 54 from polyimide resin. The insulation layers 54 may be formed from polyurea, for instance.

A fifth embodiment of the present invention is now explained with reference to FIG. 8. Since ink jet printer head of this embodiment is difference to the first, second, third and fourth embodiment of the present invention, it is described together with process for manufacturing the same.

Figure 8A:
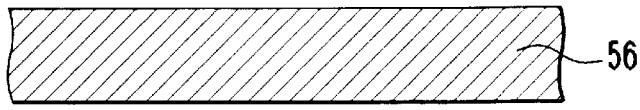
FIG. 8 is a partial longitudinal sectional view of an ink jet printer head broken away in right-angled direction to longer direction of grooves with steps for manufacturing the same according to a fifth embodiment of the present invention.
Figure 8B:
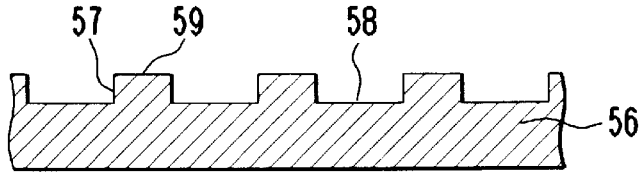

First of all, as shown in FIG. 8(A), the process requests forming a plurality of concave portions 57 on an upper surface of a piezoelectric member 56. Concavities 58 and convexity 59 are formed on the upper surface of the piezoelectric member 56 thereby as shown in FIG. 8(B).

Figure 8C:
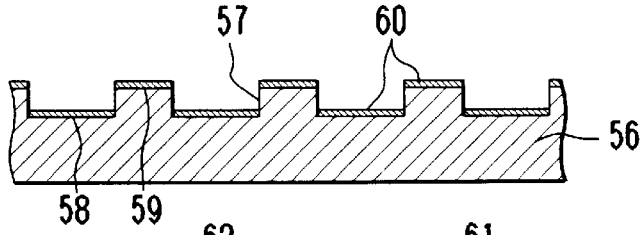
Figure 8D:
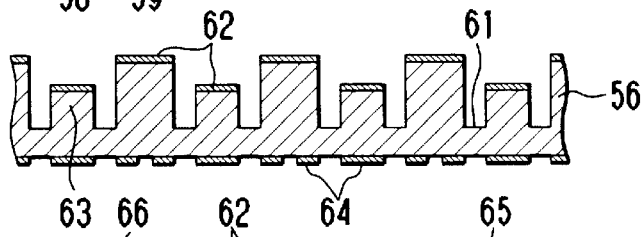

As next step, an electrode layer 60 is formed on the concavities 58 and the convexity 59 of the piezoelectric member 56 by using spattering or the like as shown in FIG. 8(C). Then, the process requests cutting the electrode layer 60 and the upper portion of the piezoelectric member 56 between the concavities 58 and convexity 59 (step) so as to divide the concavities 58 and convexity 59 by narrow grooves 61. Thus, continued electrode layer 60 is divided so as to form a plurality of electrodes 62. A plurality of convex portions 63 is also formed in each concave portion 57.

As next process, a plurality of electrodes 64 are formed on the bottom surface of the piezoelectric member 56 so as to corresponding to the electrodes 62 formed on the upper surface of the piezoelectric member 56. Explanation for forming the electrodes 62 is eliminated because it is well known, but the bottom surface of the piezoelectric member 56 is plane, the electrodes 64 having pattern corresponding to the electrodes 62 formed on the upper surface of the piezoelectric member 56 can be easily formed thereby.

Figure 8E:
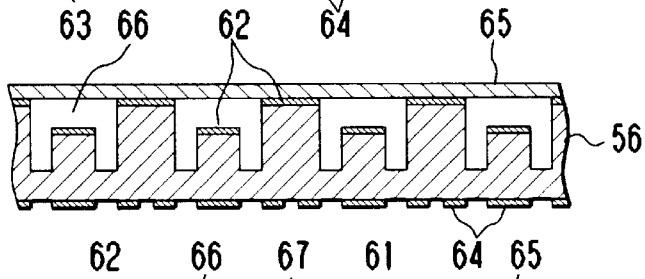

As next process, a lid 65 is attached to the upper surface of the piezoelectric member 56. A nozzle plate having nozzles (not shown) is also attached to the front surface of the piezoelectric member 56. Thus, a plurality of pressure chambers 66 is provided as shown in FIG. 8(E).

Figure 8F:
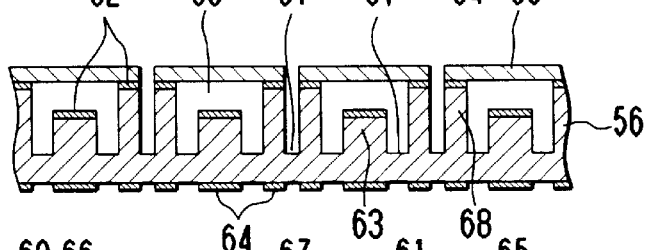
Figure 8G:
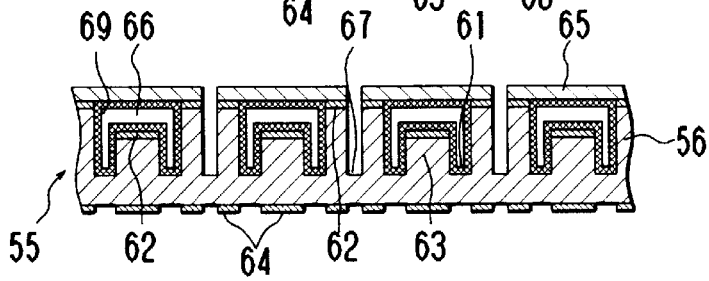

As a last process, the piezoelectric member 56 is grinded from the upper together with the lid 65, so that a plurality of dividing grooves 67 are formed which divides each convexity 59. Thus, a plurality of supports 68 is provided as shown in FIG. 8(F).

In operation of the ink jet printer head 55, reverse voltages are applied to the electrodes 62 provided at the supports 68 of the pressure chamber 66 which intends to jet the ink and the electrode 62 provided on the convex portion 63 of its pressure chamber 66 in condition of supplying ink into the pressure chambers 66. The supports 68 and the convex portion 63 corresponding to the electrodes 52 to which the voltage is applied deform so as to increase the volume in the pressure chambers 66 and restores consequently so as to decrease the volume in the pressure chambers 66. Such restoration of the supports 68 and the convex portion 63 causes the ink in the pressure chambers 66 to be pressed so as to jet the ink from the nozzle 9 as ink drop.

In the ink jet printer head 55 of the present invention, a high electric field is generated on the bottom side of the piezoelectric member 56 (making shear mode complex) in case of setting electric potentials with respect to the electrodes 62 provided on the supports 68 and the electrode 62 provided on the convex portion 63 equal, so that the piezoelectric member 56 does not work desirably. Thus, an insulation layer 69 covering the electrodes 62 provided on the supports 68 and the electrode 62 provided on the convex portion 63 with polyimide resin is formed on inside of each pressure chamber 66 (refer in FIG. 8(G)). The insulation layer 69 is formed after attaching the lid 65 to the piezoelectric member 56 and before attaching the nozzle plate to the piezoelectric member 56.

Accordingly, in case of using conductive ink, the insulation layer 69 covering the inside of the pressure chamber 66 prevents electricity to flow through the ink, so that the ink jet printer head 46 of the present invention is capable of using for a long time in steady without deterioration of the ink, producing bubbles in the ink or the like.

Since the ink jet printer head 55 of this embodiment has complicated shape in inside of the pressure chamber 66, forming layer method by using vapor deposition polymerization method is especially effective. That is, the insulation layer 69 can be formed uniformly to the fine portion in the pressure chamber 66 by using vapor deposition polymerization method.

Further, the insulation layer 69 may be formed before attaching the lid 65 to the piezoelectric member 56 or after attaching the lid 65 to the piezoelectric member 56.

Further more, this embodiment introduces to form the insulation layers 54 from polyimide resin, but the present invention does not limit to form the insulation layers 54 from polyimide resin. The insulation layers 54 may be formed from polyurea, for instance.

A sixth embodiment of the present invention is now explained with reference to FIG. 9. The same parts as those in the first embodiment are designated by the same reference numerals, and are not again explained herein.

Figure 9:
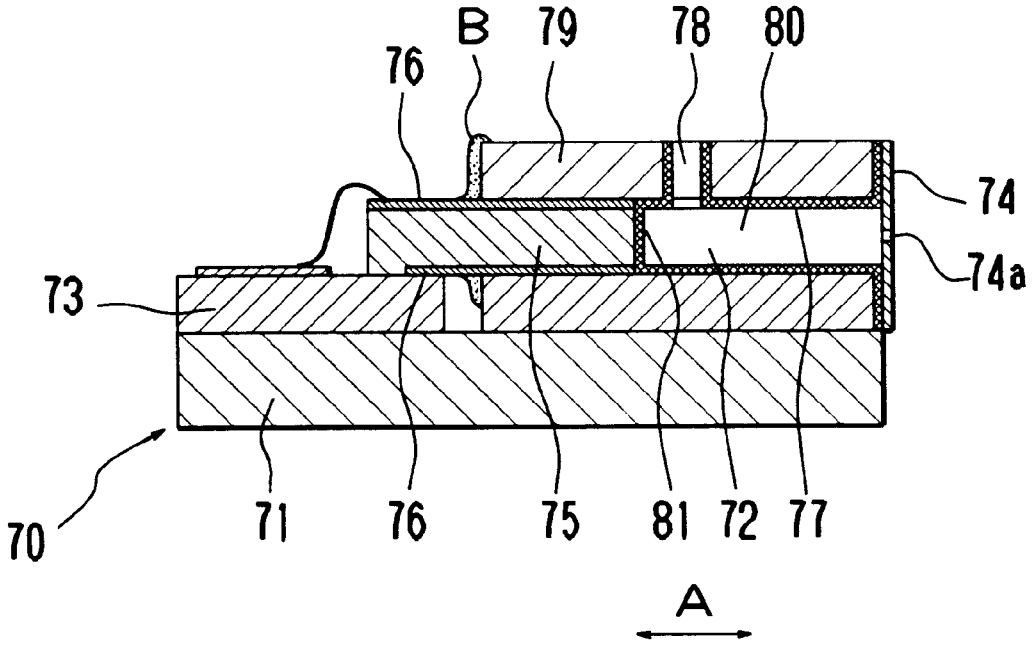
FIG. 9 is a longitudinal sectional view of an ink jet printer head broken away along longer direction of grooves according to a sixth embodiment of the present invention.

FIG. 9 is a longitudinal sectional view of an ink jet printer head broken away along longer direction of grooves according to a sixth embodiment of the present invention. A substrate 73 formed a plurality of grooves 72 in parallel is attached to a base plate 71.

The grooves 72 are formed so as to open both ends. One end of the grooves 72 is closed with a nozzle plate 74 having a plurality of nozzles 74*a*. At the other end of the grooves 72 a piezoelectric member 75 is inserted. Upper surface and bottom surface of the piezoelectric member 75 provides electrodes 76 respectively. The piezoelectric member 75 deforms longer direction of the grooves 72 (shown in arrow A in FIG. 9) with applying voltage to the electrodes 76. The piezoelectric member 75 is adhered at rear portion of the grooves 72 by adhesive B.

An upper opening 77 of the grooves 72 is closed with a lid 79 providing a supply nozzle 78. The supply nozzle 78 is connected with an ink tank (not shown) and an ink channel (not shown) for supplying ink to each pressure chambers 80 described below.

Thus, the grooves 72, the nozzle plate 74, and the lid 79 form the pressure chambers 80.

In operation of the ink jet printer head 70, voltage is applied to the electrodes 76 provided on the piezoelectric member 75 which intends to jet the ink. The piezoelectric member 75 corresponding to the electrodes 76 to which the voltage is applied is expanded and contracted in its length direction. Since the piezoelectric members 75 are adhered to the substrate 73 by the adhesion B, The piezoelectric member 75 corresponding to the electrodes 76 to which the voltage is applied deforms toward right direction in FIG. 9 so as to decrease the volume in the pressure chamber 80, the ink contained in the pressure chamber 80 jets as ink drop thereby.

When the voltage is applied to the electrodes 76 in condition of filling the pressure chambers 80 of the ink jet printer head 70 with conductive ink, since each pressure chambers 80 provides plus and minus electrodes 76, the electricity flows through the ink filled in each pressure chambers 80. The electricity flowing through the ink may cause deterioration of the ink, generating bubbles from the ink, or the like. Thus, in this embodiment of the present invention, insulation layers 81 comprised form polyimide are formed on the surface of the piezoelectric members 75 having the electrodes 76. The insulation layers 81 are formed before closing one opening ends of the grooves 72.

Accordingly, in case of using conductive ink, the insulation layer 81 covering the electrodes 76 prevents electricity to flow through the ink, so that the ink jet printer head 70 of the present invention is capable of using for a long time in steady without deterioration of the ink, producing bubbles in the ink or the like.

The piezoelectric members 75 of this embodiment have cubic shape, and the insulation layers 81 can be easily formed to the piezoelectric members 75 using well known process thereby. Especially, the insulation layers 81 can be formed at the same time by.using vapor deposition polymerization method after fabricating the ink jet printer head 70, so that the operability and workability for forming the insulation layers 81 can be improved.

Obviously, numerous modifications and variations of the present invention are possible in light of the above teachings. It is therefore to be understood that within the scope of the appended claims, the invention may be practiced otherwise than as specifically described herein.

What is claimed is:

1. An ink jet printer head, comprising:

a pressure chamber, at least part of which is formed out of piezoelectric member, to be supplied ink;

a nozzle connecting the pressure chamber to outside;

an electrode for applying voltage to the piezoelectric member; and an insulation layer covering the electrode, wherein said insulation layer includes a vapor deposited polymerized organic macromolecule material.

2. An ink jet printer head according to claim 1, wherein a plurality of pressure chambers is provided, and ink is supplied into each pressure chamber through an ink channel contributing to connect each pressure chamber to an ink tank.

3. An ink jet printer head according to claim 2, wherein the pressure chambers are provided in a space between a pair of supports, at least part of which is formed out of the piezoelectric member, the nozzle and the electrodes are provided in each pressure chamber.

4. An ink jet printer head according to claim 2, wherein the pressure chambers are provided in a space between a pair of supports, at least part of which is formed out of the piezoelectric member, the electrode is provided in each pressure chamber, the electrode comprises a pair of electrodes, at least one of which is provided on each support.

5. An ink jet printer head according to claim 1, wherein the electrode comprises a pair of electrodes.

6. An ink jet printer head according to claim 1, wherein the insulation layer contains polyurea.

7. An ink jet printer head according to claim 1, wherein the insulation layer contains polyimide.

8. A method for manufacturing an ink jet printer head, comprising the steps of:

forming a pressure chamber, at least part of which is formed out of piezoelectric member;

forming an electrode for applying voltage to the piezoelectric member; and covering the electrode with an insulation layer comprising an organic macromolecule material by a vapor deposition polymerization method.

9. A method for manufacturing an ink jet printer head according to claim 8, wherein the pressure chamber forming step includes forming a plurality of pressure chambers, further comprising the step of forming an ink channel, contributing to connect each pressure chamber to an ink tank, for supplying into each pressure chamber.

10. A method for manufacturing an ink jet printer head according to claim 8, wherein the electrode forming step includes forming a pair of electrodes.

11. A method for manufacturing an ink jet printer head according to claim 8, wherein the electrode covering step includes covering the electrode with polyurea.

12. A method for manufacturing an ink jet printer head according to claim 8, wherein the electrode covering step includes covering the electrode with polyimide.

13. An ink jet printer head, comprising:

means for receiving ink including a piezoelectric member;

means for connecting said means for receiving ink to outside;

means for applying voltage to the piezoelectric member; and means for insulating and covering the means for applying voltage including a vapor deposited polymerized organic macromolecule material.

14. An ink jet printer head according to claim 13, further including means for transporting ink contributing to connect the means for receiving ink to an ink tank, wherein ink is supplied to said means for receiving ink through the means for transporting ink.

15. An ink jet printer head according to claim 14, wherein the means for receiving ink are provided in a space between a pair of supports, at least part of which is formed out of the piezoelectric member, the means for connecting and the electrodes are provided in each of said means for receiving ink.

16. An ink jet printer head according to claim 14, wherein the means for receiving ink are provided in a space between a pair of supports, at least part of which is formed out of the piezoelectric member, the means for connecting is provided in each means for receiving ink, the means for applying voltage comprises a pair of electrodes, at least one of which is provided on each support.

17. An ink jet printer head according to claim 13, wherein the means for applying voltage comprises a pair of electrodes.

18. An ink jet printer head according to claim 13, wherein the means for insulating and covering the electrode contains polyurea.

19. An ink jet printer head according to claim 13, wherein the means for insulating and covering the electrode contains polyimide.

* * * * *